US005975626A

United States Patent [19]

Aycock

[11] Patent Number: 5,975,626

[45] Date of Patent: Nov. 2, 1999

[54] CROSS-MEMBER SUPPORTER FOR FOLDABLE FURNITURE

[75] Inventor: Michael Aycock, Pomona, Calif.

[73] Assignee: Tofasco of America Inc., Pomona, Calif.

[21] Appl. No.: 09/118,725

[22] Filed: Jul. 17, 1998

[51] Int. Cl.[6] ..... A47C 4/00

[52] U.S. Cl. ..... 297/16.1; 297/45; 297/56; 297/16.2

[58] Field of Search ..... 297/16.1, 16.2, 297/17, 25, 42, 45, 56, 195.11, 463.1, 463.2

[56] References Cited

U.S. PATENT DOCUMENTS

| | | | |
|---|---|---|---|
| 647,171 | 4/1900 | Wiles | 297/45 X |
| 4,184,711 | 1/1980 | Wakimoto | 297/16.2 |
| 4,547,015 | 10/1985 | Wakimoto | 297/16.2 |

FOREIGN PATENT DOCUMENTS

| | | | |
|---|---|---|---|
| 514306 | 5/1954 | Belgium | 297/16.2 |
| 449617 | 1/1949 | Italy | 297/56 |
| 524061 | 4/1955 | Italy | 297/45 |
| 821665 | 10/1959 | United Kingdom | 297/56 |
| 882374 | 11/1961 | United Kingdom | 297/195.11 |

*Primary Examiner*—Laurie K. Cranmer
*Attorney, Agent, or Firm*—Raymond Y. Chan; David and Raymond

[57] ABSTRACT

A cross-member supporter for foldable furniture enables at least two construction members to selectively be supported in strongly extended cross structure or be folded in parallel compact structure for easy storage and carrying purposes. The cross-member supporter includes a supporter body having at least two vertical connecting holes and two inclined supporting holes provided therethrough. The two inclined supporting holes are inclined in opposite direction. The two inclined supporting holes are respectively extended from top to bottom through the two vertical connecting holes to form two supporting through slots. An axis of the vertical connecting hole of each of the supporting through slots is intersected with an axis of the respective inclined supporting hole, wherein each of the supporting through slots defines an upper supporting groove and a lower supporting groove which are inclined in opposite direction. The two elongated stems are penetrated through and pivotally connected at the two supporting through slots respectively. Thereby, each of the elongated stems can be inclinedly rested and supported by an upper groove surface and a lower groove surface of the respective inclined supporting hole so as to form a cross construction.

9 Claims, 8 Drawing Sheets

CROSS-MEMBER SUPPORTER FOR FOLDABLE FURNITURE

FILED OF THE PRESENT INVENTION

The present invention relates to foldable furniture, and more particularly to a cross-member supporter for foldable furniture, which enables at least two construction members to selectively be supported in strongly extended cross structure or be folded in parallel compact structure for easy storage and carrying purposes.

BACKGROUND OF THE PRESENT INVENTION

Cross-member construction is the most popular structure in foldable furniture. As shown in FIG. 1, a conventional cross-member construction is illustrated as a simple foldable stool or footstand. It comprises a first U-shape member 11 having two parallel stems 111, 112 respectively connected with two parallel stems 121, 122 of a second U-shape member 12 by means of cross-member construction, wherein a middle position of each of the stems 111, 112, 121, 122 provides a hole so that a connecting means 13, such as rivet or bolt and nut, is able to pivotally connect two corresponding stems 111 & 121 or 112 & 122 in such middle position by penetrating through the holes thereon. Accordingly, the two connecting stems 111 & 121 or 112 & 122 form a cross-member construction.

Such conventional cross-member construction enables the two stems 111 & 121 or 112 & 122 to selectively stretch apart from each other to form a X-shaped structure as shown in FIG. 1 or fold towards each other along the arrows shown in FIG. 1. It is well known that the conventional connecting means 13 can only pivotally connect two stems together but fails to provide any supporting to the two stems. In order to support the two U-shape members 11, 12 in position to form the X-shaped structure, at least a foldable supporting frame 14 must be mounted between the two stems. However, such supporting frame 14 can only limit the stretching distance between the two stems 111, 121. The weight of the sitter is almost fully supported by the rivets 13 connecting the stems and the supporting frame. In other words, such conventional cross-member construction fails to support heavy loading. Oppositely, the connecting means 13 of the conventional crossmember construction is easier to be damaged because it bears most of the loading stress.

Moreover, the user must also manually help to fold up the supporting frame 14 before folding up the foldable furniture. Sometimes, if the user fails to ensure the supporting fame 14 being fully stretched out, the cross-member construction will become very weak and may cause danger to the sitter. Besides, the manufacturer has to process excess step to install the supporting frame 14 that may unreasonably increase the manufacturing cost.

SUMMARY OF THE PRESENT INVENTION

It is thus a first object of the present invention to provide a cross-member supporter for foldable furniture, which enables at least two construction members to selectively be supported in strongly extended cross structure or be folded in parallel compact structure for easy storage and carrying purposes.

A further object of the present invention is to provide a cross-member supporter for foldable furniture, which not only can enables the construction members to stretch apart from each other to form a predetermined cross construction, but also can enforce the supporting strength of the cross construction without the need of any additional supporting component.

Yet another object of the present invention is to provide a cross-member supporter for installing to a foldable furniture, which enables the user to extend and fold the foldable furniture easily. Moreover, the downward loading applied to the foldable furniture is capable of ensuring the cross construction to fully stretch and rigidly stand in position.

Still another object of the present invention is to provide a cross-member supporter for foldable furniture, wherein a single cross-member supporter is sufficient to construct a tri-pod stool that can support more loading, so that it can substantially reduce the construction cost.

Still another object of the present invention is to provide a cross-member supporter for foldable furniture, which can reduce the manufacturing steps, construction parts and cost of the foldable furniture.

Accordingly, in order to accomplish the above objects, the present invention provides a cross-member supporter adapted to connect at least two elongated stems of a foldable furniture. The cross-member supporter comprises a supporter body having a predetermined thickness. The supporting body has at least two vertical connecting holes and two inclined supporting holes provided therethrough. The two inclined supporting holes are inclined in opposite direction. The two inclined supporting holes are respectively extended from top to bottom through the two vertical connecting holes to form two supporting through slots. An axis of the vertical connecting hole of each of the supporting through slots is intersected with an axis of the respective inclined supporting hole, wherein each of the supporting through slots defines an upper supporting groove and a lower supporting groove which are inclined in opposite direction. The two elongated stems are penetrated through and pivotally connected at the two supporting through slots respectively. Thereby, each of the elongated stems can be inclinedly rested and supported by an upper groove surface and a lower groove surface of the respective inclined supporting hole so as to form a cross construction.

DETAILED DESCRIPTION OF THE PREFERRED EMBODIMENT

Figure 1:
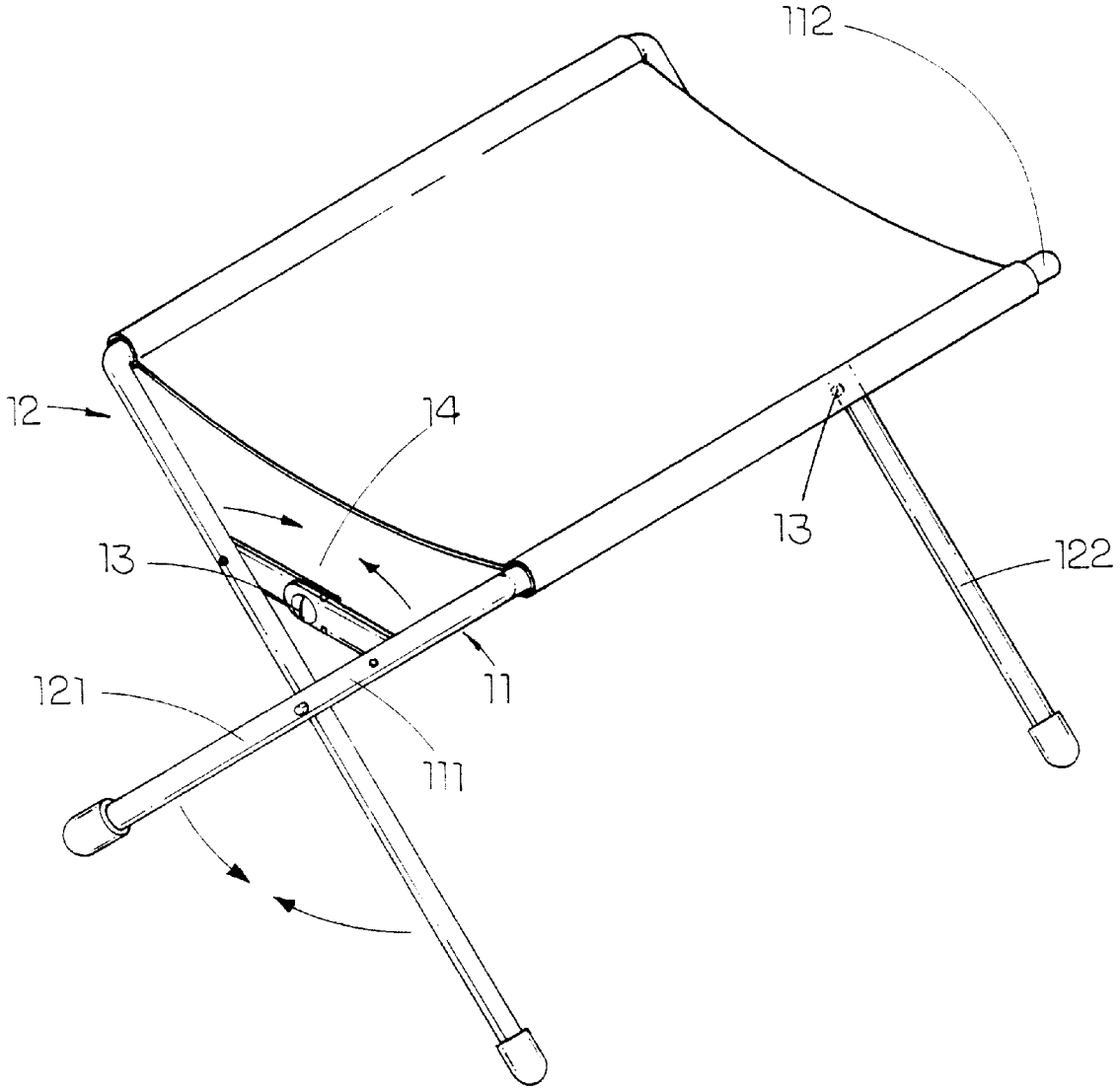
FIG. 1 PRIOR ART
FIG. 1 is a perspective view of a conventional stool.

Referring to FIGS. 1 to 4, a cross-member supporter 20 for foldable furniture according to a first preferred embodiment of the present invention is illustrated. The cross-member supporter 20 is adapted to pivotally connect two elongated stems 51, 52 of a foldable furniture.

The cross-member supporter 20 comprises a supporter body 21 which is a rectangular solid body made of metal of plastic having a predetermined thickness. The supporting body 21 has two supporting through slots 22, 23 parallelly provided thereon. Each of the two supporting through slots 22, 23 is composed of a vertical connecting hole 221, 231 and an inclined supporting hole 222, 232.

Figure 3A:
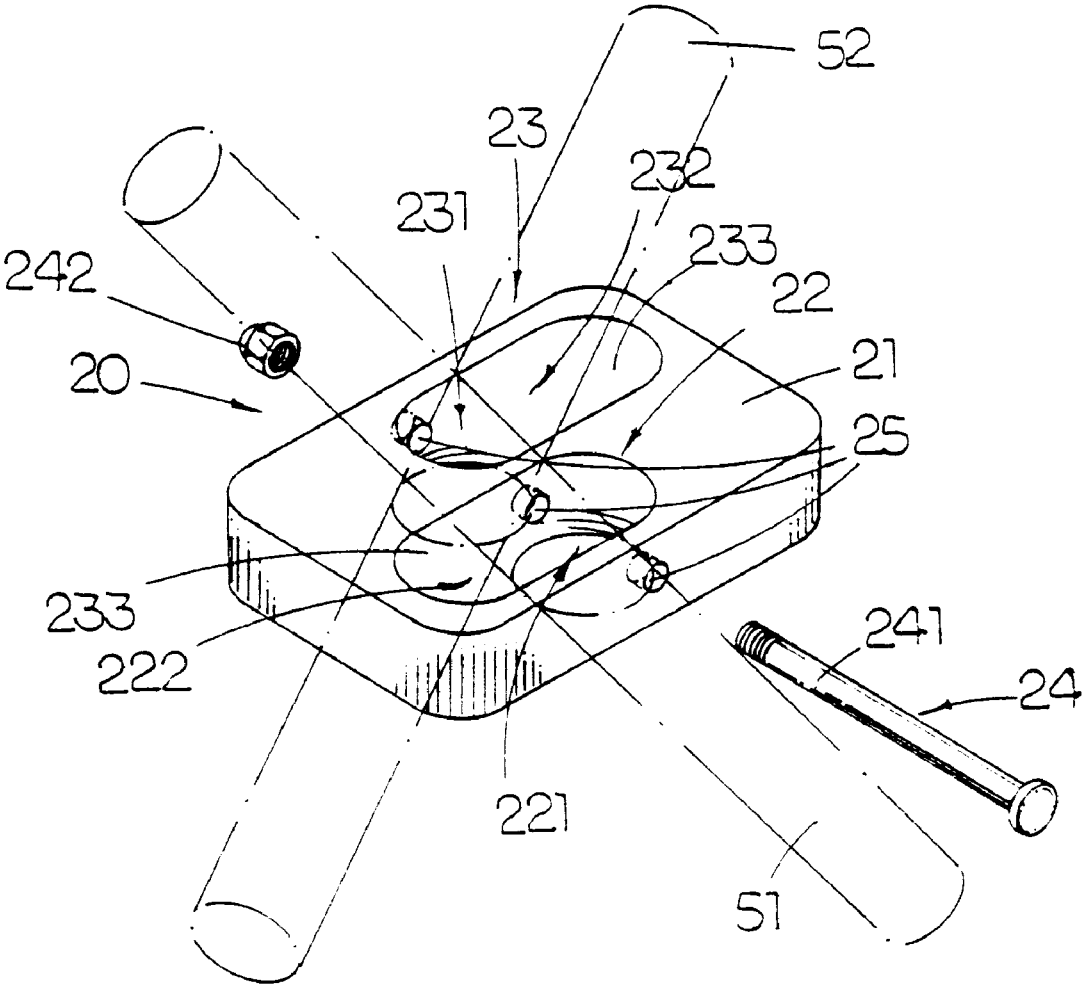
FIG. 3A is a perspective top view of the cross-member supporter for foldable furniture according to the above first preferred embodiment of the present invention, wherein two inclined stems are illustrated by hypothetical lines to show a cross construction.
Figure 3B:
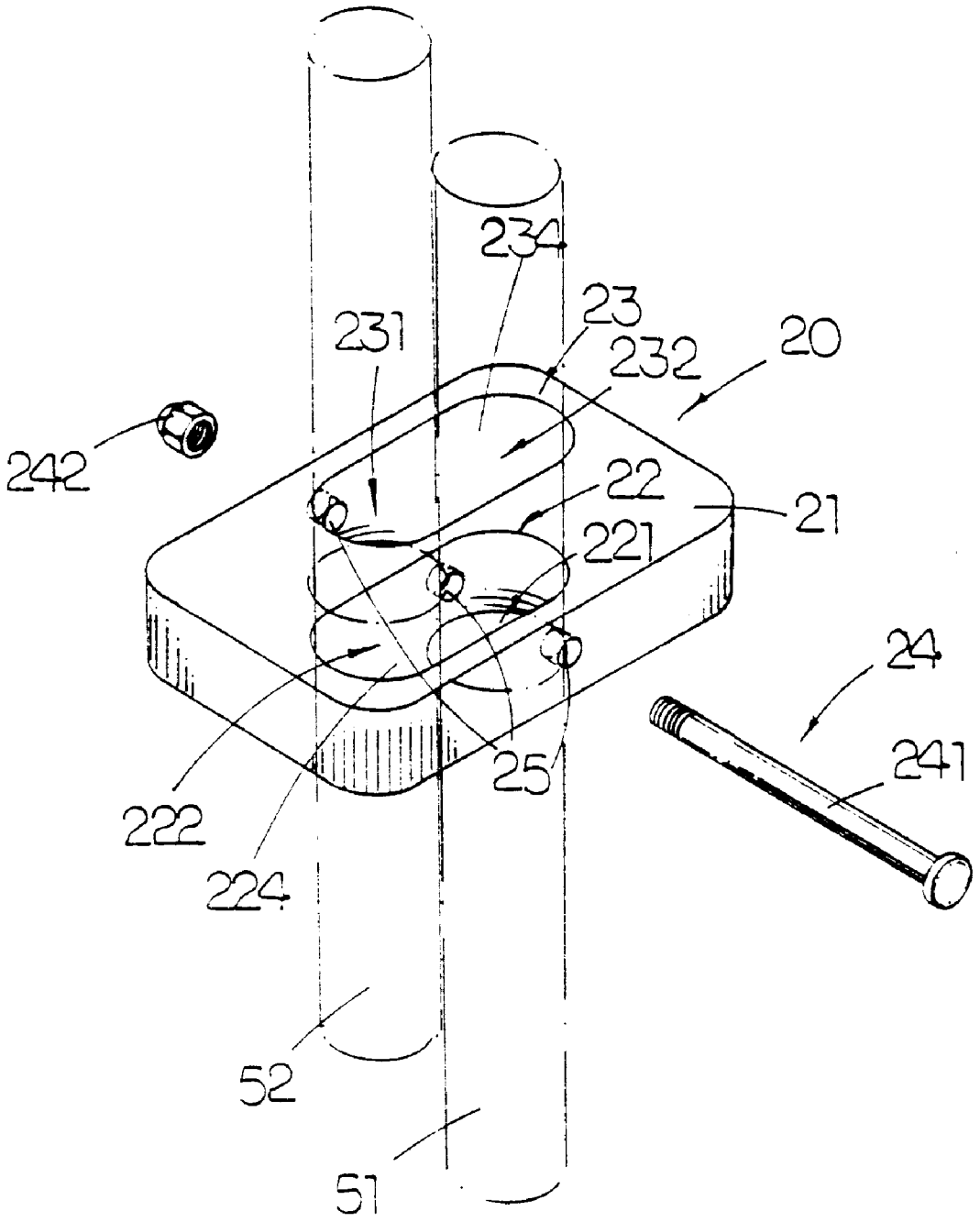
FIG. 3B is a perspective bottom view of the cross-member supporter for foldable furniture according to the above first preferred embodiment of the present invention, wherein two stems illustrated by phantom lines are positioned parallelly and vertically.

The two vertical connecting holes 221, 231 are perpendicular to the supporter body 21. The two vertical connecting holes 221, 231 are vertically extended through the supporter body 21 and the two inclined supporting holes 222, 232 are inclinedly extended through the supporter body 21, wherein the two inclined supporting holes 222, 232 are inclined in opposite direction. One of the inclined supporting holes 222 is extended from upper left to lower right while another inclined supporting hole 232 is extended from upper right to lower left, as shown in FIGS. 3A and 3B. Preferably, the diameter of the two vertical connecting holes 221, 231 are equal to the diameter of the two inclined supporting holes 222, 232.

Moreover, the two inclined supporting holes 222, 232 are respectively extended from top to bottom through the two vertical connecting holes 221, 231 to define the two supporting through slots 22, 23, so that an axis of the vertical connecting hole 221, 231 of each of the supporting through slots 22, 23 is intersected with an axis of the respective inclined supporting hole 222, 232. Accordingly, each of the supporting through slots 22, 23 defines an upper supporting groove 223, 233 and a lower supporting groove 224, 234 which are inclined in opposite direction.

The two elongated stems 51, 52 are penetrated through the two supporting through slots 22, 23 respectively. The cross-member supporter 20 further comprises a connecting means 24 for pivotally connecting the two stems 51, 52 at the two supporting through slots 22, 23 respectively. Thereby, each of the elongated stems 51, 52 can be inclinedly rested and supported by the upper groove surface 223, 233 and the lower groove surface 224, 234 of the respective inclined supporting hole 222, 232 so as to form a cross construction, as shown in FIG. 3A. As shown in FIG. 3B, the two elongated stems 51, 52 can also be rotated to vertical position in order to fold up the cross construction.

Figure 4:
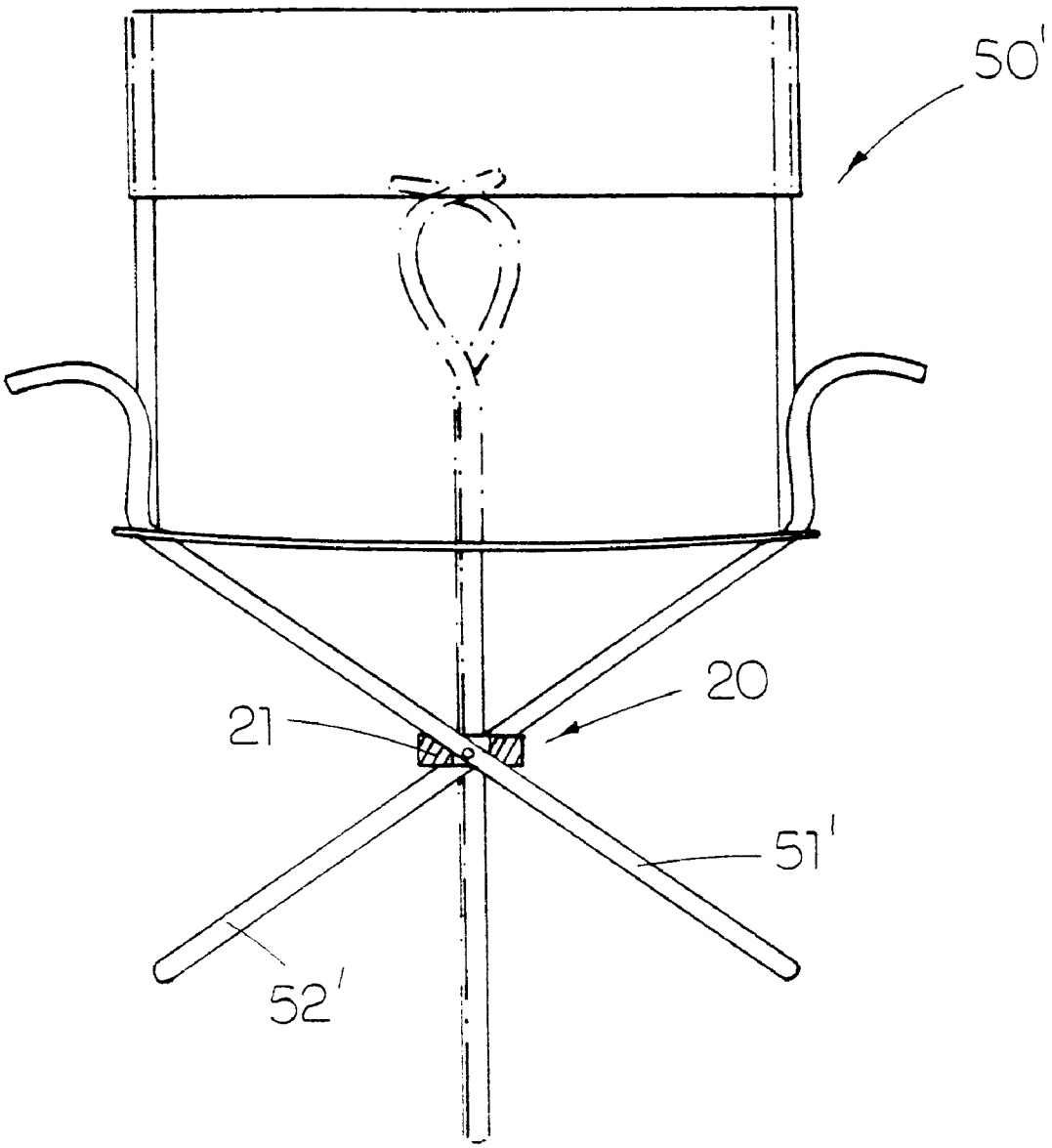
FIG. 4 is a front view of a foldable furniture equipped with the cross-member supporter according to the above first preferred embodiment of the present invention.

As shown in FIG. 4, an embodying example of the cross-member supporter 20 is illustrated, wherein the cross-member supporter 20 is utilized to pivotally connect two leg stems 51', 52' of a foldable chair 50'. When the two leg stems 51', 52' are inclinedly positioned, a X-shaped cross construction is formed. When the two leg stems 51', 52' are vertically positioned, the chair 50' can be folded up.

Figure 2:
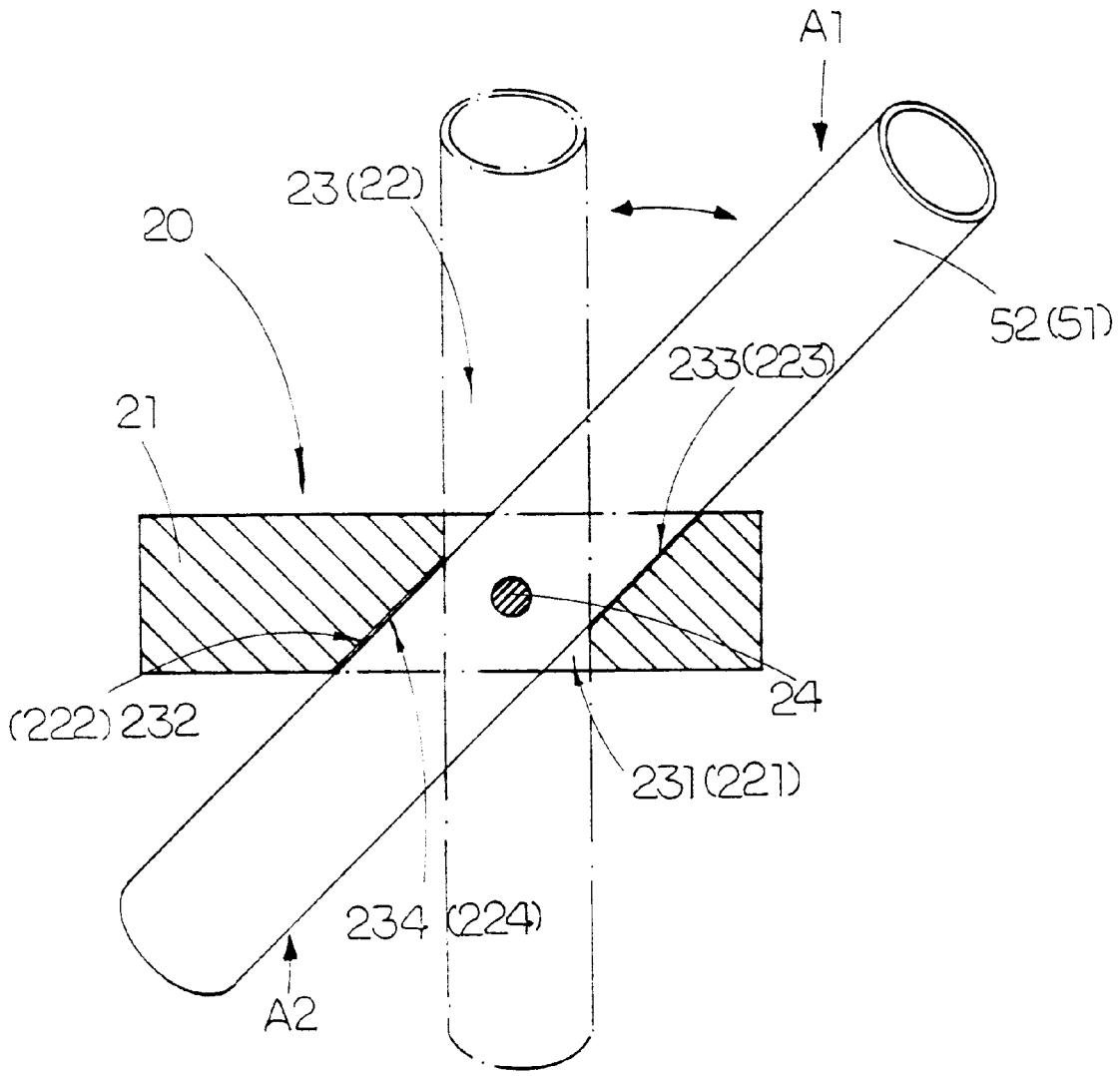
FIG. 2 is a sectional view of a cross-member supporter for foldable furniture according to a first preferred embodiment of the present invention, illustrating a stem inclinedly supported thereto.

Referring to FIG. 2, according to the present invention, the inclinedly positioned stem 51, 52 is strongly supported by the respective supporting through slot 22, 23. When a downward loading force A1 is applied to the stem 51, 52, a portion of the lower surface of the stem 51, 52 is rested and supported by the upper supporting groove 223, 233 and a portion of the upper surface of the stem 51, 52 is rested by the lower supporting groove 224, 234. Therefore, the reaction force A2 is well supported by the lower supporting groove 224, 234. Moreover, since the two stems 51, 52 are inclined in opposite direction, the loading force can be evenly supported and balanced by the supporter body 21. The greater the loading force will ensure a more firmly construction.

Due to the fact that the loading force A1 is supported by the supporter body 21, the presence of the connecting means 24 is merely for pivotally connecting the two stems 51, 52 with the supporter body 21. Nearly no stress will be applied to the connecting means 24. Therefore, a simple connecting means 24 such as a bolt and nut structure, a rivet or a screw is applicable to the present invention. As shown in FIGS. 3A and 3B, the connecting means 24 comprises a bolt 241 and a nut 242. A transverse through hole 25 penetrating through the walls of the two supporting through slots 22, 23 is provided on the supporter body 21, so that the bolt 241 can be inserted through the transverse through hole 25 at one side and locked in position by the nut 242 at another side.

Figure 5:
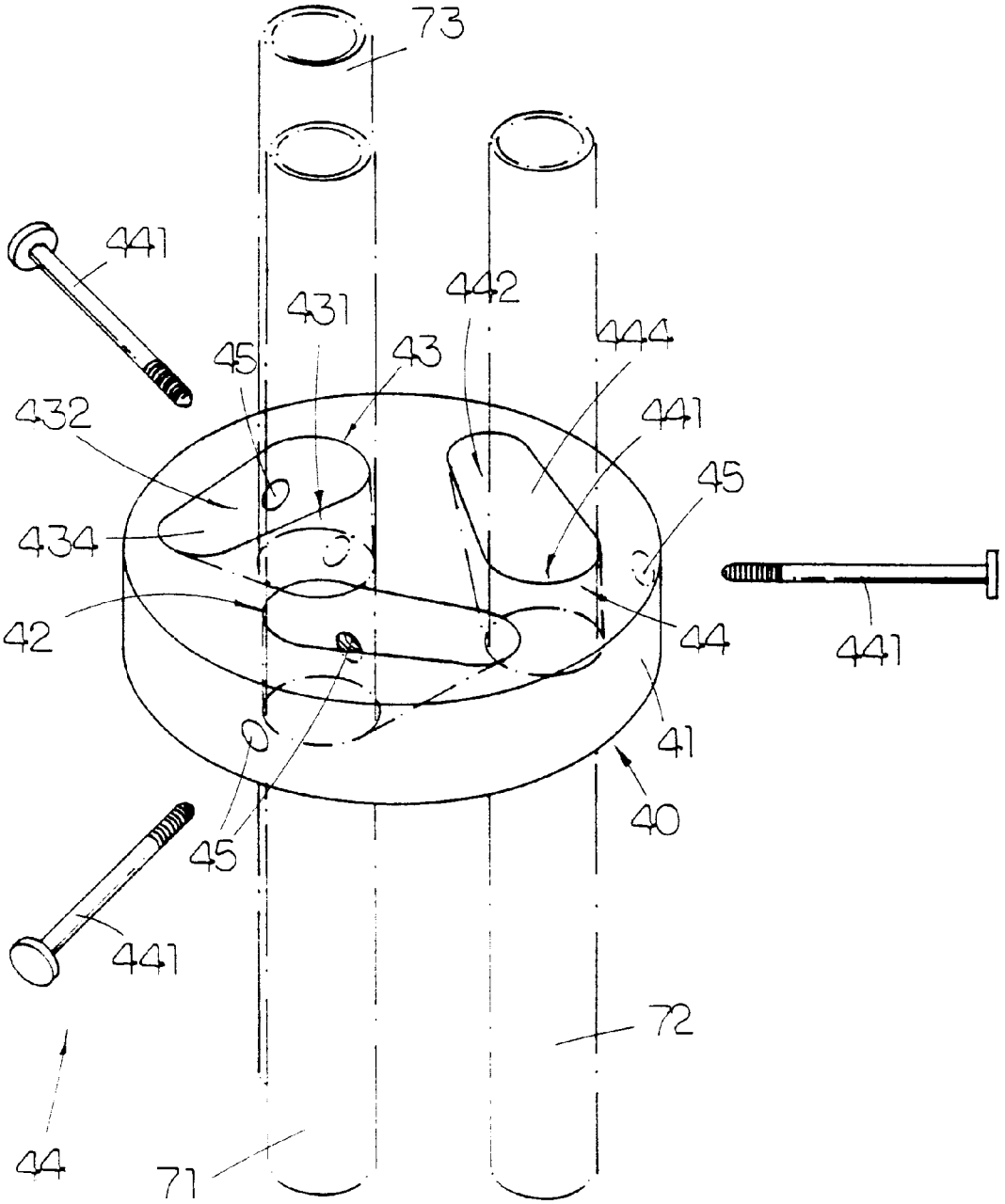
FIG. 5 is a perspective view of a cross-member supporter for foldable furniture according to a second preferred embodiment of the present invention.
Figure 6:
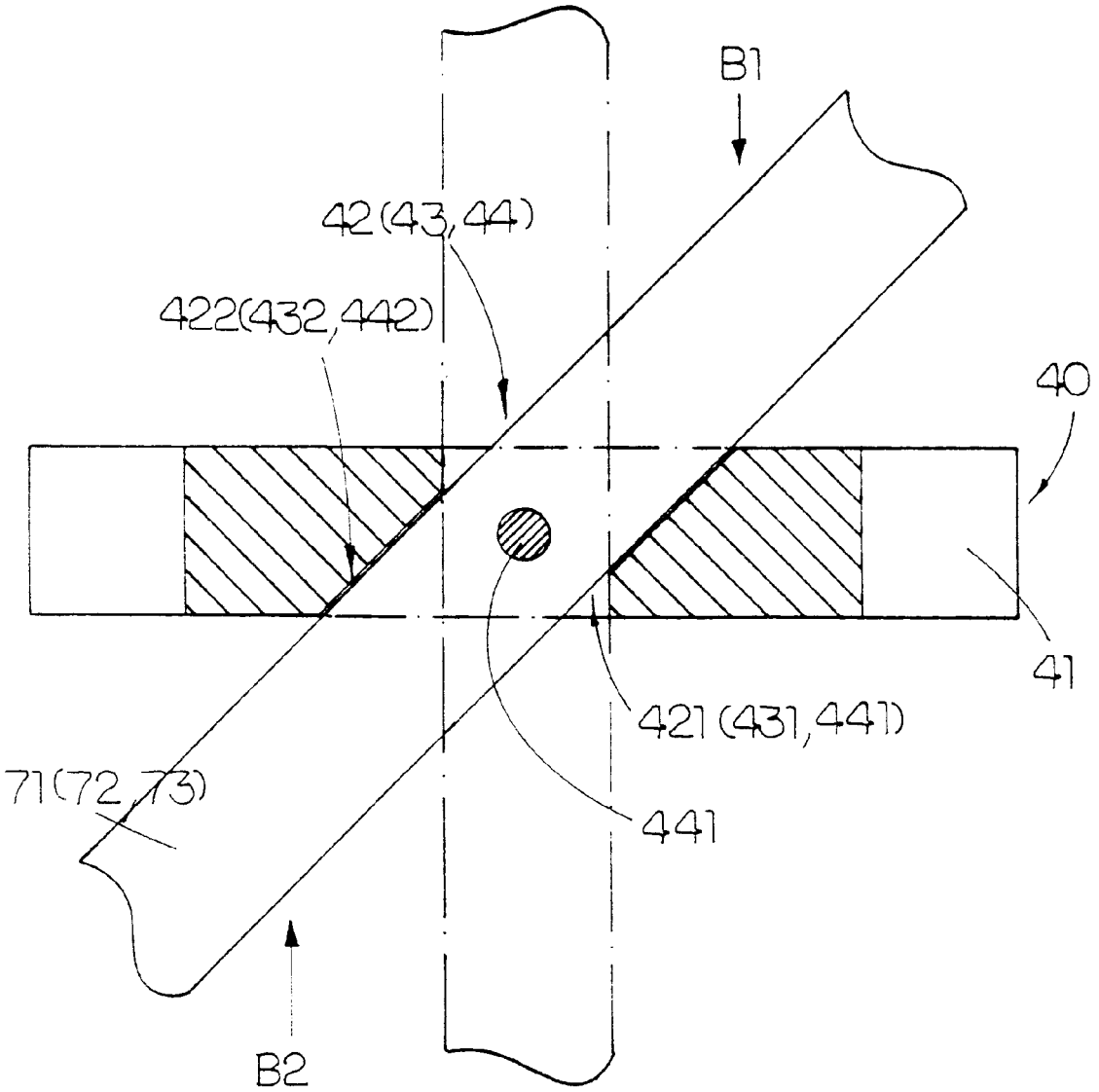
FIG. 6 is a sectional view of the cross-member supporter for foldable furniture according to the above second preferred embodiment of the present invention, illustrating a stem inclinedly supported thereto.
Figure 7:
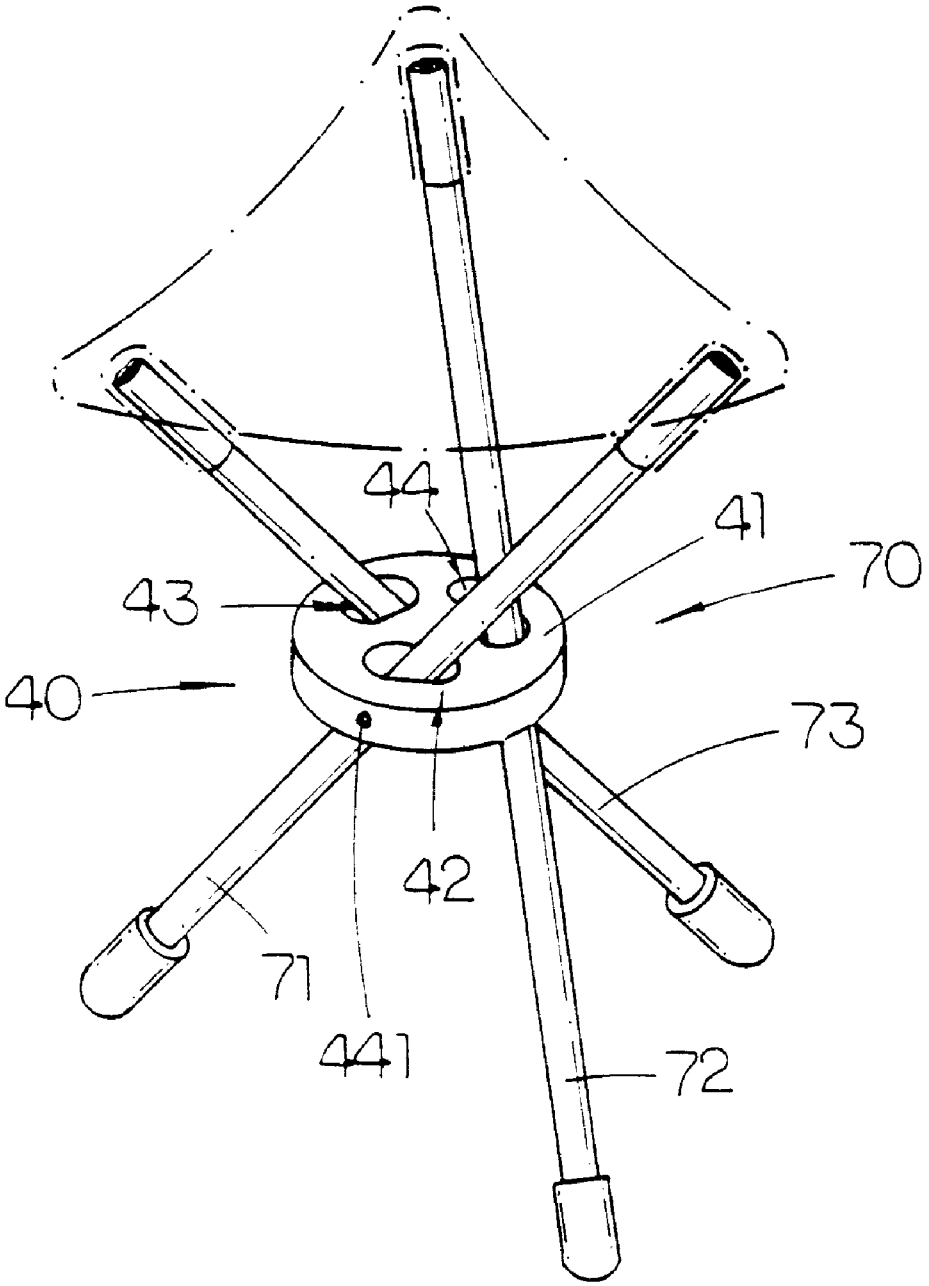
FIG. 7 is a perspective view of a tri-pod stool constructed by the cross-member supporter according to the above second embodiment of the present invention.

Referring to FIGS. 5 to 7, a cross-member supporter 40 for foldable furniture according to a second embodiment of the present invention is illustrated. The cross-member supporter 20 is adapted to pivotally connect three elongated stems 71, 72, 73 to form a tri-pod stool 70 as shown in FIG. 7.

Similar to the above first embodiment, the cross-member supporter 40 also comprises a supporter body 41 which is a circular solid body made or metal or plastic having a predetermined thickness. The supporting body 41 has three supporting through slots 42, 43, 44 circularly positioned thereon. Each of the three supporting through slots 42, 43, 44 is composed of a vertical connecting hole 421, 431, 441 and an inclined supporting hole 422, 432, 442 as shown in FIG. 5 and 6.

As shown in FIGS. 5 and 6, the three vertical connecting holes 421, 431, 441 are perpendicular to the supporter body 41. The three vertical connecting holes 421, 431, 441 are vertically extended through the supporter body 41 and the three inclined supporting holes 422, 432, 442 are inclinedly extended through the supporter body 41, wherein the three inclined supporting holes 422 432, 442 are inclined in different predetermined direction. Preferably, the diameter of the three vertical connecting holes 421, 43 1, 441 are equal to the diameter of the three inclined supporting holes 422, 432, 442.

Moreover, as shown in FIG. 6, the three inclined supporting holes 422, 432, 442 are respectively extended from top to bottom through the three vertical connecting holes 421, 431, 441 to define the three supporting through slots 42, 43, 44, so that an axis of the vertical connecting hole 421, 431, 441 of each of the supporting through slots 42, 43, 44 is intersected with an axis of the respective inclined supporting hole 422, 432, 442. Accordingly, each of the supporting through slots 42, 43, 44 defines an upper supporting groove surface 423, 433, 443 on top of the supporter body 41 and a lower supporting groove surface 424, 434, 444 on bottom of the supporter body 41, which are inclined in opposite direction.

The three elongated stems 71, 72, 73 are penetrated through the three supporting through slots 42, 43, 44 respectively. The cross-member supporter 40 further comprises a connecting means 44 for pivotally connecting the three stems 71, 72, 73 at the three supporting through slots 42, 43, 44 respectively. Thereby, as shown in FIG. 6, each of the elongated stems 71, 72, 73 can be inclinedly rested and supported by the upper supporting groove surface 423, 433, 443 and the lower supporting groove surface 424, 434, 444 of the respective inclined supporting hole 422, 432, 442 so as to form a cross construction, as shown in FIG. 7. As shown in FIG. 5, the three elongated stems 71, 72, 73 (shown as dotted lines ) can also be rotated to vertical position in order to fold up the cross construction.

Referring to FIG. 6, according to the second embodiment of the present invention, the inclinedly positioned stem 71 (72, 73) is strongly supported by the respective supporting through slot 42 (43, 44). When a downward loading force B1 is applied to the stem 71 (72, 73), a portion of the lower surface of the stem 61 (62, 63) is rested and supported by the upper supporting groove surface 423 (433, 443) and a portion of the upper surface of the stem 71 (72, 73) is rested by the lower supporting groove surface 424 (434, 444). Therefore, the reaction force B2 is well supported by the lower supporting groove surface 424 (434, 444). Moreover, since the three stems 71, 72, 73 are inclined in different directions, the loading force B1 can be evenly supported and balanced by the supporter body 41. The greater the loading force will ensure a more firmly construction.

As shown in FIG. 7, an embodying example of the cross-member supporter 40 is illustrated, wherein the cross-member supporter 40 is utilized to pivotally connect the three stems 71, 72, 73 of the tri-pod stool 70. When the three stems 71, 72, 73 are inclinedly positioned, a tri-pod shaped cross construction is formed. When the three stems 71, 72, 73 are vertically positioned, the tri-pod stool 70 is folded up.

It is worth to mention again, since the loading force B1 is supported by the supporter body 41, the presence of the connecting means 44 is merely for pivotally connecting the three stems 71, 72, 73 with the supporter body 41. Nearly no stress will be applied to the connecting means 44. Therefore, a simple connecting means 44 such as a bolt and nut structure, a rivet or a screw is applicable to the present invention. As shown in FIGS. 5, the connecting means 44 comprises three screws 441. Three transverse through holes 45 respectively penetrating through the walls of the three supporting through slots 42, 43, 44 are provided on the supporter body 41, so that the three screws 441 can be inserted through the three transverse through holes 45 respectively.

In view of the above disclosure, the present invention can substantially achieve the following advantages:

1. The cross-member supporter for foldable furniture enables at least two construction members to selectively be supported in strongly extended cross structure or be folded in parallel compact structure for easy storage and carrying purposes.

2. The cross-member supporter for foldable furniture not only can enables the construction members to stretch apart from each other to form a predetermined cross construction, but also can enforce the supporting strength of the cross construction without the need of any additional supporting component.

3. The cross-member supporter for installing to a foldable furniture enables the user to extend and fold the foldable furniture easily. Moreover, the downward loading applied to the foldable furniture is capable of ensuring the cross construction to fully stretch and rigidly stand in position.

4. A single cross-member supporter is sufficient to construct a tri-pod stool that can support more loading, so that it can substantially reduce the construction cost.

5. The cross-member supporter for foldable furniture can reduce the manufacturing steps, construction parts and cost of the foldable furniture.

What is claimed is:

1. A cross-member supporter adapted to pivotally connect at least two elongated stems of a foldable furniture, comprising:

a supporter body having a predetermined thickness, said supporting body having at least two vertical connecting holes and at least two inclined supporting holes provided therethrough, each of said inclined supporting holes being inclined in different direction, said at least two inclined supporting holes being respectively extended from top to bottom through said at least two vertical connecting holes to form at least two supporting through slots, wherein an axis of said vertical connecting hole of each of said supporting through slots is intersected with an axis of said respective inclined supporting hole and a diameter of each of said vertical connecting holes is substantially equal to a diameter of each of said stems and said inclined supporting holes, wherein each of said supporting through slots provides an upper supporting groove surface and a lower supporting groove surface which are inclined in opposite direction, said at least two elongated stems being penetrated through and pivotally connected at said at least two supporting through slots respectively, wherein each of said elongated stems is capable of inclinedly resting and being supported by said upper supporting groove surface and said lower supporting groove surface of said respective inclined supporting hole so as to form a cross construction.

2. A cross-member supporter, as recited in claim 1, wherein said two supporting through slots are parallelly provided on said supporter body and said at least two inclined supporting holes are inclined in opposite direction.

3. A cross-member supporter, as recited in claim 2, wherein said at least two vertical connecting holes are perpendicular to said supporter body.

4. A cross-member supporter, as recited in claim 1, wherein said at least two vertical connecting holes are perpendicular to said supporter body.

5. A cross-member supporter, as recited in claim 1, further comprising a connecting means for pivotally connecting said stems at said supporting through slots respectively.

6. A cross-member supporter, as recited in claim 5, wherein said connecting means comprises a bolt and a nut, a transverse through hole penetrating through walls of said supporting through slots being provided on said supporter body, wherein said bolt is inserted through said transverse through hole at one side of said supporter body and locked in position by said nut at another side of said supporter body.

7. A cross-member supporter, as recited in claim 1, wherein said supporter body has totally three supporting through slots circularly aligned thereon for pivotally connecting with three stems to form a tri-pod shaped cross construction.

8. A cross-member supporter, as recited in claim 7, further comprising a connecting means for pivotally connecting said three stems at said three supporting through slots.

9. A cross-member supporter, as recited in claim 8, wherein said connecting means comprises three screws, moreover three transverse through holes respectively penetrating through walls of said three supporting through slots are provided on said supporter body, wherein said three screws are inserted and secured through said three transverse through holes respectively.

* * * * *

US005975626C1

(12) EX PARTE REEXAMINATION CERTIFICATE (9210th)

United States Patent
Aycock

(10) Number: US 5,975,626 C1
(45) Certificate Issued: Aug. 21, 2012

(54) CROSS-MEMBER SUPPORTER FOR FOLDABLE FURNITURE

(75) Inventor: Michael Aycock, Pomona, CA (US)

(73) Assignee: IP Power Holdings Limited, Tortola (VG)

Reexamination Request:
No. 90/011,984, Oct. 27, 2011

Reexamination Certificate for:

| | |
|---|---|
| Patent No.: | **5,975,626** |
| Issued: | **Nov. 2, 1999** |
| Appl. No.: | **09/118,725** |
| Filed: | **Jul. 17, 1998** |

(51) Int. Cl.
*A47C 4/00* (2006.01)
*A47C 1/02* (2006.01)

(52) U.S. Cl. ..... 297/16.1; 297/45; 297/56; 297/16.2

(58) Field of Classification Search ..... None
See application file for complete search history.

(56) References Cited

To view the complete listing of prior art documents cited during the proceeding for Reexamination Control Number 90/011,984, please refer to the USPTO's public Patent Application Information Retrieval (PAIR) system under the Display References tab.

*Primary Examiner*—Beverly M. Flanagan

(57) ABSTRACT

A cross-member supporter for foldable furniture enables at least two construction members to selectively be supported in strongly extended cross structure or be folded in parallel compact structure for easy storage and carrying purposes. The cross-member supporter includes a supporter body having at least two vertical connecting holes and two inclined supporting holes provided therethrough. The two inclined supporting holes are inclined in opposite direction. The two inclined supporting holes are respectively extended from top to bottom through the two vertical connecting holes to form two supporting through slots. An axis of the vertical connecting hole of each of the supporting through slots is intersected with an axis of the respective inclined supporting hole, wherein each of the supporting through slots defines an upper supporting groove and a lower supporting groove which are inclined in opposite direction. The two elongated stems are penetrated through and pivotally connected at the two supporting through slots respectively. Thereby, each of the elongated stems can be inclinedly rested and supported by an upper groove surface and a lower groove surface of the respective inclined supporting hole so as to form a cross construction.

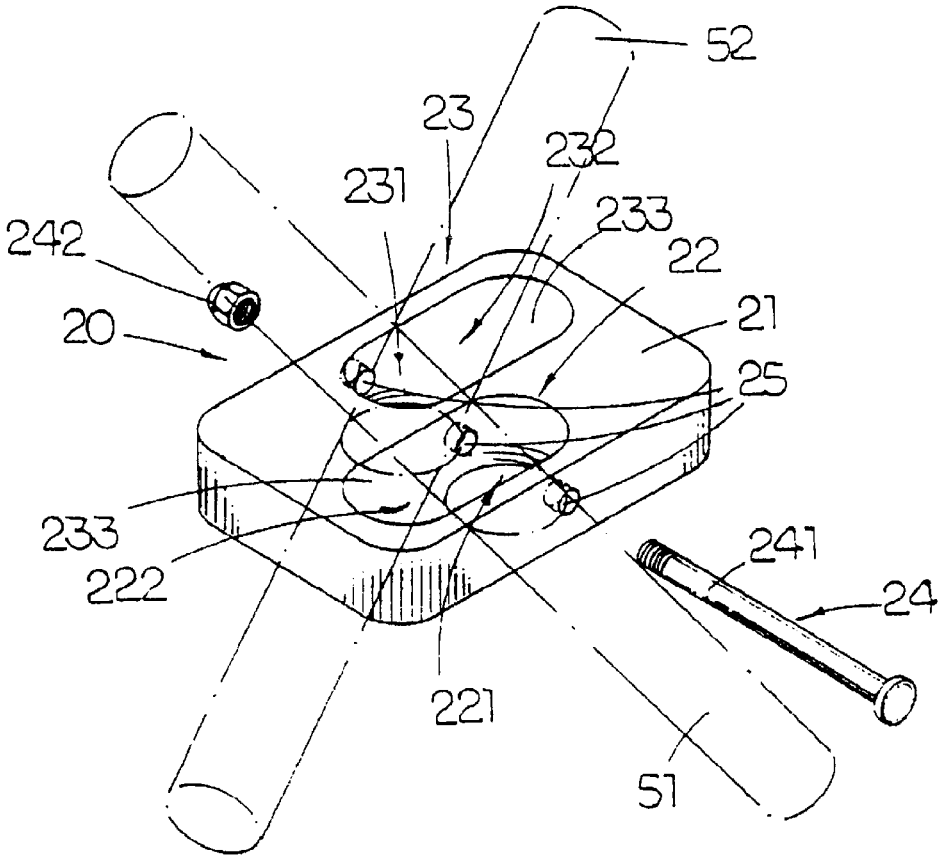

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 6 are determined to be patentable as amended.

Claims 2-5 and 7-9, dependent on an amended claim, are determined to be patentable.

New claims 10-16 are added and determined to be patentable.

1. A cross-member supporter adapted to pivotally connect at least two elongated stems of a foldable furniture, comprising:

a supporter body having a predetermined thickness, said supporting body having at least two vertical connecting holes and at least two inclined supporting holes provided therethrough, each of said inclined supporting holes being inclined in different direction, said at least two inclined supporting holes being respectively extended from top to bottom through said at least two vertical connecting holes to form at least two supporting through slots, wherein an axis of said vertical connecting hole of each of said supporting through slots is intersected with an axis of said respective inclined supporting hole and a diameter of each of said vertical connecting holes is substantially equal to a diameter of each of said stems and said inclined supporting holes, wherein each of said supporting through slots provides an upper supporting groove surface and a lower supporting groove surface which are inclined in opposite direction, said at least two elongated stems being penetrated through and pivotally connected at said at least two supporting through slots respectively, wherein each of said elongated stems is capable of inclinedly resting and being supported by said upper supporting groove surface and said lower supporting groove surface of said respective inclined supporting hole so as to form a cross construction*; and*

*a transverse through hole penetrating through walls of said supporting through slots being provided on said supporter body.*

6. A cross-member supporter, as recited in claim 5, wherein said connecting means comprises a bolt and a nut, [a transverse through hole penetrating through walls of said supporting through slots being provided on said supporter body,] wherein said bolt is inserted through said transverse through hole at one side of said supporter body and locked in position by said nut at another side of said supporter body.

*10. A cross-member supporter, as recited in claim 5, wherein said connecting means comprises a rivet.*

*11. A cross-member supporter, as recited in claim 5, wherein said connecting means comprises a screw.*

*12. A cross-member supporter, as recited in claim 5, wherein said connecting means comprises a bolt and a nut.*

*13. A cross-member supporter, as recited in claim 5, wherein said connecting means comprises a rivet wherein said rivet is inserted through said transverse through hole at one side of said supporter body and secured in position at another side of said supporter body.*

*14. A cross-member supporter, as recited in claim 5, wherein said connecting means comprises a screw wherein said screw is inserted through said transverse through hole at one side of said supporter body and secured in position at another side of said supporter body.*

*15. A cross-member supporter, as recited in claim 8, wherein said connecting means comprises three rivets, moreover three transverse through holes respectively penetrating through walls of said three supporting through slots are provided on said supporter body, wherein said three rivets are inserted and secured through said three transverse through holes respectively.*

*16. A cross-member supporter, as recited in claim 8, wherein said connecting means comprises three bolts and nuts, moreover three transverse through holes respectively penetrating through walls of said three supporting through slots are provided on said supporter body, wherein said three bolts are inserted and secured through said three transverse through holes and locked in position by said nut.*

* * * * *